US010881197B2

(12) United States Patent
Rylands

(10) Patent No.: US 10,881,197 B2
(45) Date of Patent: Jan. 5, 2021

(54) GRILL-CLEANING TOOL

(71) Applicant: Dusty Rylands, Auburn, WA (US)

(72) Inventor: Dusty Rylands, Auburn, WA (US)

(73) Assignee: RYLANDS PRODUCT INNOVATIONS LLC, Auburn, WA (US)

( * ) Notice: Subject to any disclaimer, the term of this patent is extended or adjusted under 35 U.S.C. 154(b) by 361 days.

(21) Appl. No.: 15/462,818

(22) Filed: Mar. 18, 2017

(65) Prior Publication Data

US 2017/0340188 A1 Nov. 30, 2017

Related U.S. Application Data

(60) Provisional application No. 62/343,584, filed on May 31, 2016.

(51) Int. Cl.

| | |
|---|---|
| ***A47L 17/00*** | (2006.01) |
| ***A47L 13/34*** | (2006.01) |
| ***A46D 1/00*** | (2006.01) |
| ***A46B 15/00*** | (2006.01) |
| ***A47L 13/08*** | (2006.01) |
| ***A47L 13/12*** | (2006.01) |

(52) U.S. Cl.

CPC ..... *A46B 15/0081* (2013.01); *A46B 15/0063* (2013.01); *A46D 1/0207* (2013.01); *A47L 13/08* (2013.01); *A47L 13/12* (2013.01); *A47L 13/34* (2013.01); *A46B 2200/3073* (2013.01); *A46B 2200/3093* (2013.01)

(58) Field of Classification Search

CPC ..... A47L 13/06; A47L 13/08; A47L 13/12; A47L 13/34; A46B 15/0081; A46B 15/0063; A46B 2200/3073; A46B 2200/3093; A46D 1/0207

USPC ..... 15/236.01, 236.05, 236.08, 236.09; 30/169

See application file for complete search history.

(56) References Cited

U.S. PATENT DOCUMENTS 4,229,032 A * 10/1980 Murphy ..... A47L 13/08 15/236.06
5,373,600 A * 12/1994 Stojanovski ..... A47L 13/34 15/111

(Continued)

FOREIGN PATENT DOCUMENTS

DE 202015000686 U1 * 6/2015 ..... A61C 17/08

*Primary Examiner* — Marc Carlson
(74) *Attorney, Agent, or Firm* — Olympic Patent Works PLLC

(57) ABSTRACT

The current document is directed to a new type of grill-cleaning tool that includes one or more scrapers as well as freely sliding scraping pins that conform to the surfaces of a grill to assist the one or more scrapers in removing grease and cooking debris from the surfaces of the grill. The scraping pins are rigid pins, made from durable materials, with scraping-pin shafts generally having diameters or widths of 2 mm or more, as a result of which the scraping pins are not susceptible to shedding and breakage during normal cleaning operations. In addition, unlike brush bristles, the scraping pins are spaced apart from one another and have relatively low surface-area to scraping-pin-number ratios, which decreases the tendency of the scraping pins to become clogged with grease and cooking debris relative to metal brush bristles and greatly facilitates cleaning grease and cooking debris from the grill-cleaning tool.

8 Claims, 8 Drawing Sheets

(56) References Cited

U.S. PATENT DOCUMENTS

| | | | | |
|---|---|---|---|---|
| 5,467,498 | A * | 11/1995 | Keegan | A47L 13/08 15/236.01 |
| 9,943,885 | B1 * | 4/2018 | Rosenberger | B08B 1/005 |
| 2005/0086755 | A1 * | 4/2005 | Dalias | A46B 9/028 15/111 |
| 2006/0207042 | A1 * | 9/2006 | Di Paolo | A46B 5/0095 15/111 |
| 2008/0143128 | A1 * | 6/2008 | Kuhns | A47L 13/08 294/51 |
| 2011/0239392 | A1 * | 10/2011 | Levy | A46B 7/026 15/207.2 |
| 2012/0023689 | A1 * | 2/2012 | Weinberger | A47J 43/288 15/111 |
| 2012/0028551 | A1 * | 2/2012 | Weinberger | A47J 43/288 451/526 |
| 2013/0061411 | A1 * | 3/2013 | Witzel | A47L 17/00 15/106 |
| 2017/0008039 | A1 * | 1/2017 | Weinberger | A47J 43/288 |
| 2017/0326599 | A1 * | 11/2017 | Muschaweck | B08B 1/005 |

* cited by examiner

GRILL-CLEANING TOOL

CROSS-REFERENCE TO RELATED APPLICATION

This application claims priority of U.S. Provisional Application No. 62/343,584, filed May 31, 2016.

TECHNICAL FIELD

The current document is directed to hand-held cleaning tools and, in particular, to a hand-held grill-cleaning tool that features one or more scrapers and a set of freely sliding scraping pins that conform to the surfaces of a grill to assist the one or more scrapers in removing grease and cooking debris from the surfaces of the grill.

BACKGROUND

A variety of different types of grill-cleaning tools are currently available. Many of these grill-cleaning tools employ brushes with metal bristles for removing grease and cooking debris from grill surfaces. However, the brushes often shed metal bristles and portions of metal bristles during cleaning operations. The metal bristles and portions of metal bristles may remain on or near the grill surfaces and, as a result, may contaminate foods subsequently prepared on the grill. Furthermore, brushes with metal or fibrous bristles become easily clogged with grease and cooking residues. In many cases, these clogged brushes are difficult or nearly impossible to clean, decreasing the effectiveness of cleaning operations and significantly reducing the useful lifetime of brush-based grill-cleaning tools.

SUMMARY

The current document is directed to a new type of grill-cleaning tool that includes one or more scrapers as well as freely sliding scraping pins that conform to the surfaces of a grill to assist the one or more scrapers in removing grease and cooking debris from the surfaces of the grill. The scraping pins are rigid pins, made from durable materials, with scraping-pin shafts generally having diameters or widths of 2 mm or more, as a result of which the scraping pins are not susceptible to shedding and breakage during normal cleaning operations. In addition, unlike brush bristles, the scraping pins are spaced apart from one another and have relatively low surface-area to scraping-pin-number ratios, which decreases the tendency of the scraping pins to become clogged with grease and cooking debris relative to metal brush bristles and greatly facilitates cleaning grease and cooking debris from the grill-cleaning tool.

DETAILED DESCRIPTION

Figure 1A:
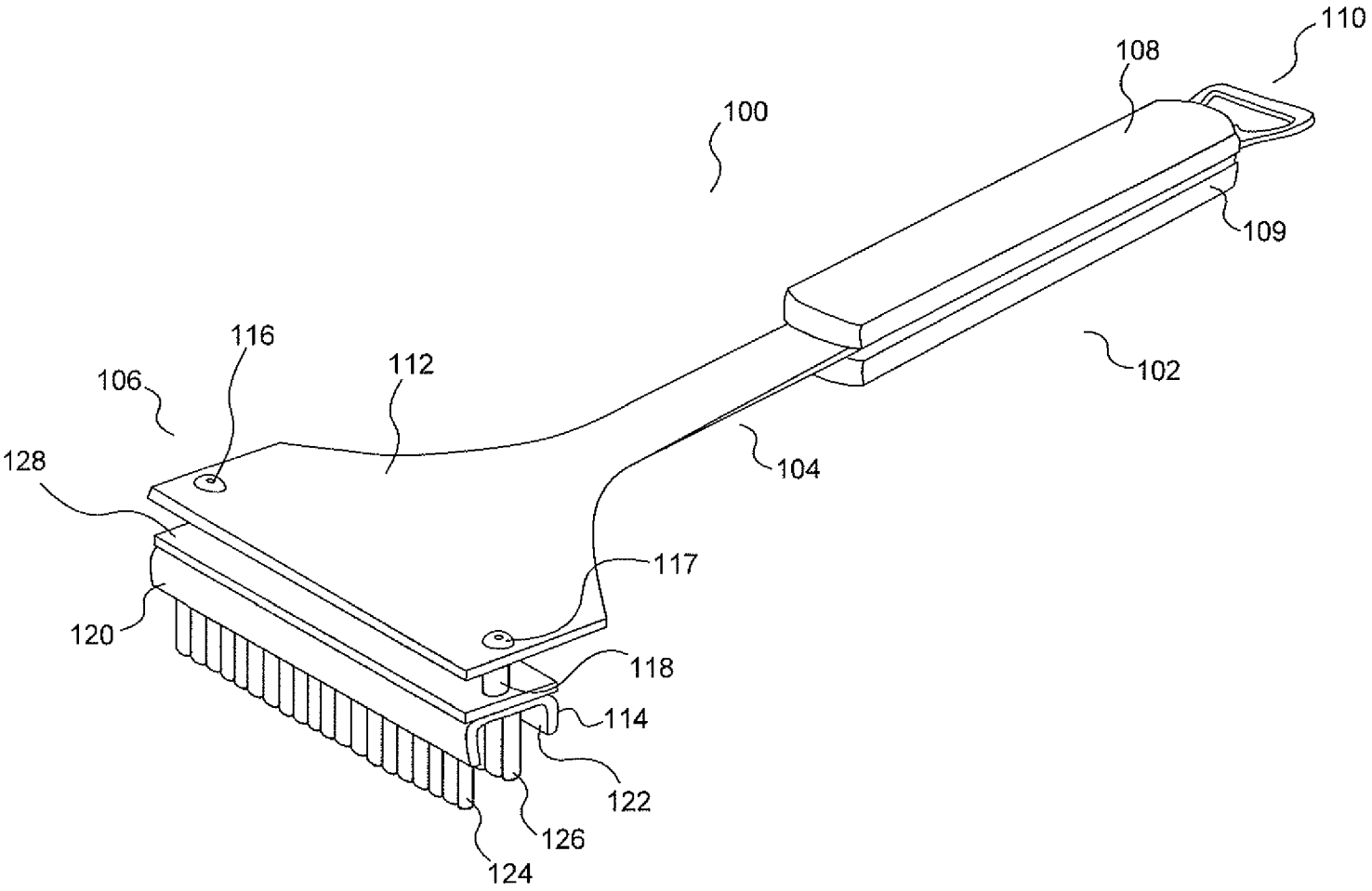
FIGS. 1A-C provide three different perspective views of the currently disclosed grill-cleaning hand tool.
Figure 1B:
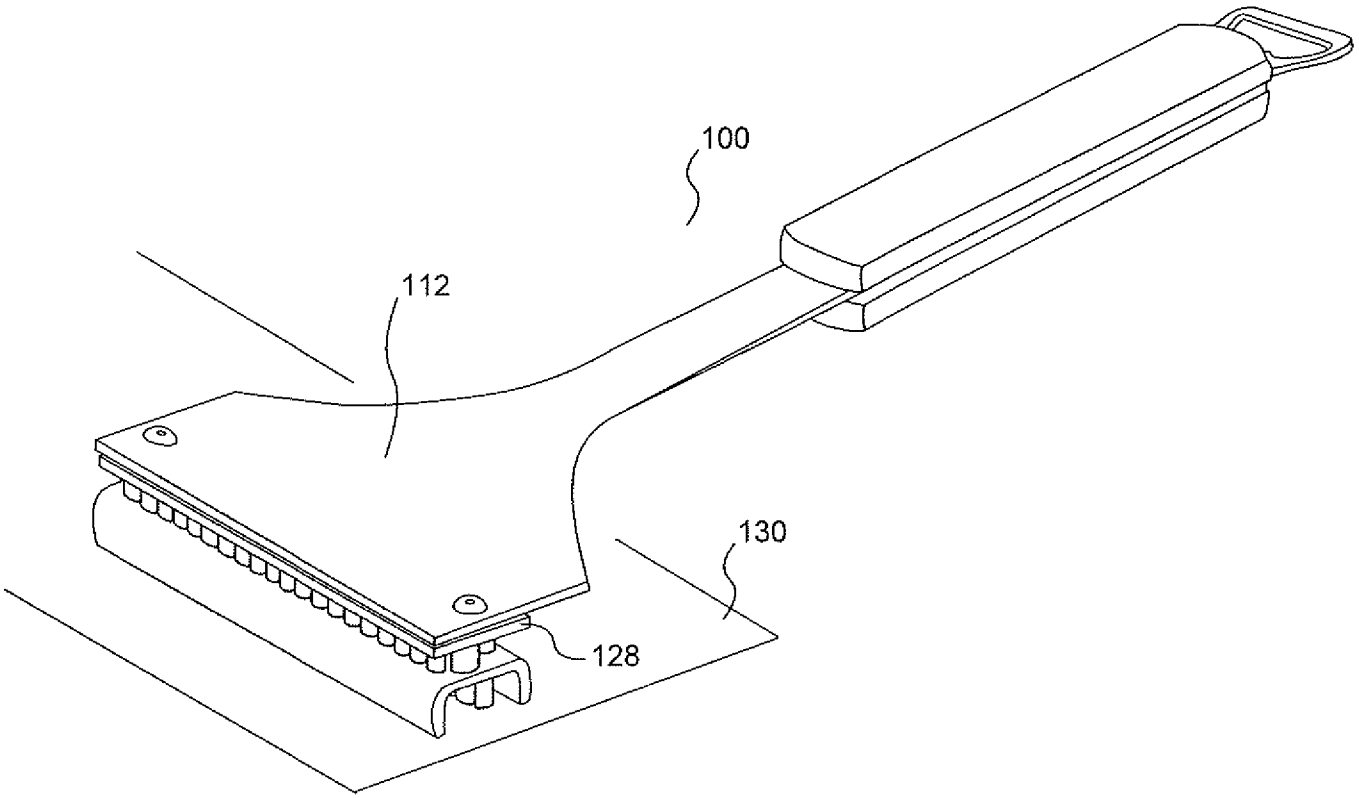
Figure 1C:
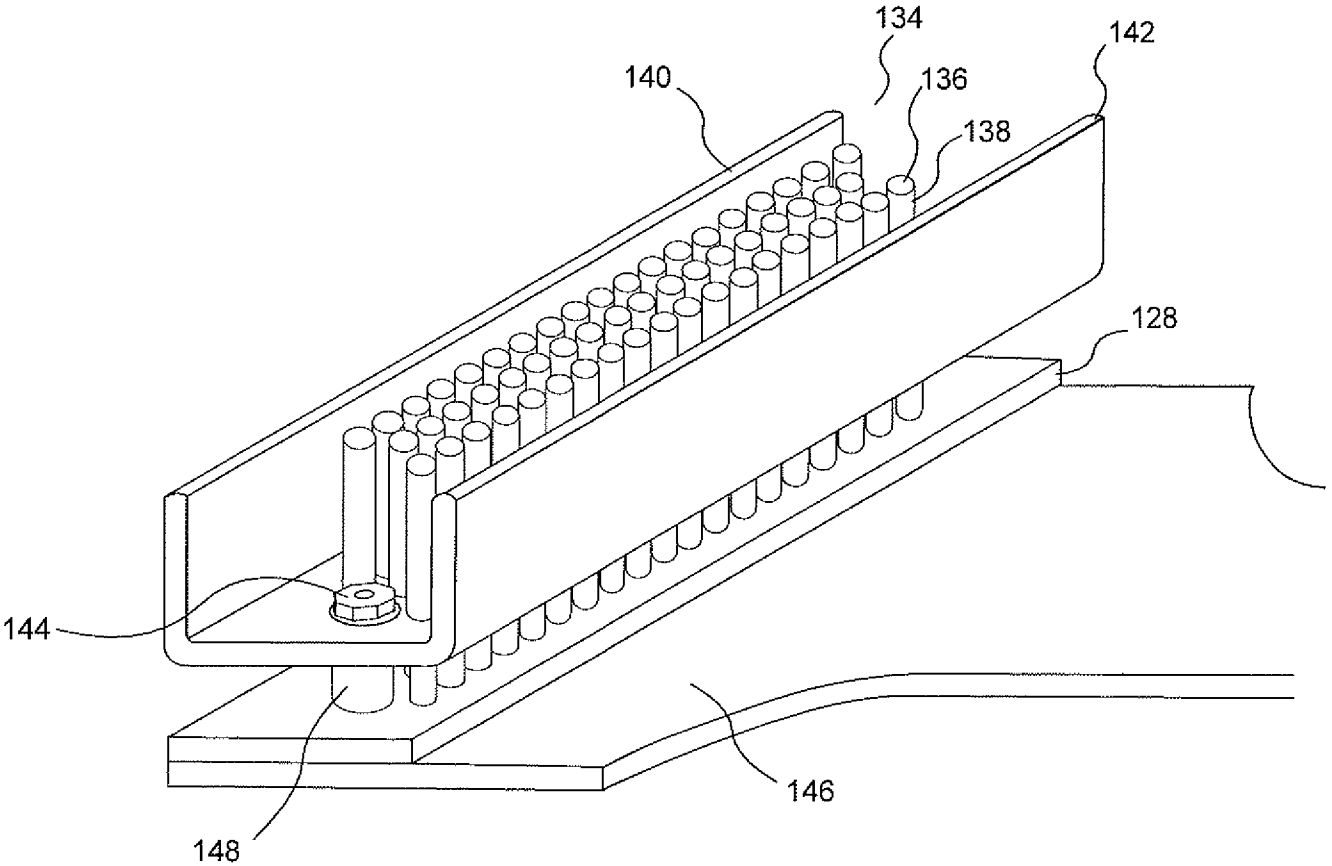

The current document is directed to a new type of grill-cleaning hand tool that features one or more scrapers and a set of freely sliding scraping pins that conform to the surfaces of a grill to assist the one or more scrapers in removing grease and other cooking debris from the surfaces of the grill. FIGS. 1A-C provide three different perspective views of the currently disclosed grill-cleaning hand tool.

FIG. 1A shows the currently disclosed grill-cleaning hand tool viewed from slightly above, and to the side, when positioned to initiate a cleaning operation but prior to contact with a surface, such as a grill. The currently disclosed grill-cleaning tool 100 includes a handle 102, a tool shaft 104 that, in the implementation shown, extends through the handle, and a cleaning-and-scraping head 106. In the implementation shown in the FIG. 1A, the handle 102 includes two wooden, plastic, ceramic, or metal handle members 108-109 that are fastened to each side of the tool shaft 104. The handle members may be fastened to the tool shaft using any of various different types of mechanical fasteners, including threaded bolts, rivets, or pins. In alternate implementations, the handle members may be fastened to the shaft using adhesives. In other implementations, the handle members may be molded, or fused to, the shaft. In certain implementations, the handle may be alternatively formed, by casting or machining, as a thicker, rounded portion of the tool shaft.

In the implementation shown in FIG. 1A, the tool shaft ends in a bottle opener 110. In alternate implementations, the tool shaft may end at or before the end of the handle members or may end in a hanger loop, scraping tool, or another type of useful implement. The useful implement at the end of the currently disclosed grill-cleaning tool may either be formed from, or as part of, the tool shaft or may be alternatively affixed to the end of the tool shaft or handle.

In the implementation shown in the FIG. 1A, the tool shaft has a narrow, thin, approximately rectangular shape that widens into a top portion 112 of the cleaning-and-scraping head. The tool shaft is, in the implementation shown in FIG. 1A, slightly inclined upward with respect to the flat surface of the top portion, or top member, of the cleaning-and-scraping head 112 to provide for natural and efficient manipulation of the grill-cleaning tool during cleaning operations. A trough-like scraping member 114 is rigidly affixed to the cleaning-and-scraping-head top member by two fasteners 116-117 and two spacers, of which one spacer 118 is visible in FIG. 1A. In the implementation shown in FIG. 1A, the two fasteners 116-117 are threaded bolts secured by lock washers and nuts on the interior surface of the trough-like scraping member 114 and therefore not visible in FIG. 1A. The spacers 118 are cylindrical tubes through which the shafts of the threaded bolts pass. The inner diameters of the spacers are larger than the diameter of two holes in each of the cleaning-and-scraping-head top member and the trough-like scraping member through which the threaded-bolt fasteners 116-117 pass. The spacers therefore hold the trough-like scraping member at a fixed distance below the lower surface of the cleaning-and-scraping-head top member. The trough-like scraping member 114 includes a forward scraping edge 120 and a rear scraping edge 122, both having widths perpendicularly oriented to the long dimension of the tool shaft and equal to the length of the trough-like scraping member. The trough-like scraping member additionally includes a set of scraping-pin apertures, not visible in FIG. 1A, through which the shafts of multiple scraping pins pass, including a first row of scraping pins 124 and a third row of scraping pins 126 partly visible in FIG. 1A. A weight bar 128 is shown resting on the top surfaces of the scraping-pin heads, discussed below and illustrated in subsequent figures. The weight bar has two apertures with diameters greater than the outer diameter of the spacers 118 so that the weight bar can freely slide in a vertical direction between the top surface of the trough-like scraping member and the bottom surface of the cleaning-and-scraping-head top member 112. The weight bar pushes down on the scraping pins in order to position the scraping pins as far downward, in a vertical direction, as possible below the forward and rear scraping edges 120 and 122. The scraping pins have pin heads with diameters greater than the diameters of the scraping-pin apertures in the top surface of the scraping member 114 to prevent the scraping pins from falling through the trough-like scraping member 114. Thus, when the grill-cleaning tool is orientated as shown in FIG. 1A and suspended in air without touching a grill or other surface, the weight bar 128 rests on the scraping-pin heads which, in turn, rest on the top surface of the trough-like scraping member 114 or within the scraping-pin apertures, depending on whether or not the scraping pins are counter sunk into the trough-like scraping member via a funnel-like shape of the scraping-pin heads and a complementary funnel-like shape of the scraping-pin apertures. The weight bar 128 serves to push the scraping pins back downward after they have been forced upward by application of the grill-cleaning tool to a grill or surface during a cleaning operation. This continuously repositions the scraping pins to be able to again conform to whatever surface the grill-cleaning tool is next applied.

Of course, many alternate implementations of the grill-cleaning tool shown in FIG. 1A are possible. In general, the tool shaft, weight bar, trough-like scraping member, and scraping pins are manufactured from durable and rigid materials, such as stainless steel. However, many other rust-resistant metals and polymeric materials may be used in alternative implementations. While the implementation shown in FIG. 1A employs threaded fasteners 116-117, other types of mechanical fasteners may be used, including stamped rivet-like fasteners or pin-like fasteners secured by smaller pins or other mechanical devices that that pass through horizontal holes in the pin-like fastener shafts. In the implementation shown in FIG. 1A, the scraping pins are cylindrical. However, scraping pins with square, rectangular, hexagonal, or other cross-section shapes may be used in alternative implementations. In the implementation shown in FIG. 1A, all of the scraping pins have identical dimensions, but, in alternative implementations, the scraping pins may have two or more different cross-sectional shapes and cross-sectional dimensions.

FIG. 1B shows the currently disclosed grill-cleaning tool resting on a flat surface 130. In this position and orientation, the scraping pins are pushed upward, in the vertical direction, by one or both of the force of the application of the grill-cleaning tool downward onto the surface and the weight of the grill-cleaning tool pushing downward under the force of gravity. The bottoms of the scraping pins together form a flat surface in conformance with, and contiguous with, the flat surface 130 to which the grill-cleaning tool has been applied. Note that the weight bar 128 is now pushed upward against the bottom surface of the cleaning-and-scraping-head top member 112. As in the position and orientation shown in FIG. 1A, the weight bar 128 rests on top of the scraping-pin heads.

FIG. 1C shows a perspective view of the cleaning-and-scraping head of the currently disclosed grill-cleaning tool when viewed in an upward vertical direction through a clear surface onto which the grill-cleaning tool has been applied. In this view, the flat surface 134 created by the bottom surfaces of the scraping pins, such as the bottom surface 136 of scraping pin 138, is shown along with the forward scraping edge 140 and the rear scraping edge 142. The nut 144 that secures the threaded-bolt fastener 116, not visible in this view, is also shown in FIG. 1C. The lock washers below the nuts are not visible in any of the figures. The weight bar 128 is pushed up to the lower surface 146 of the cleaning-and-scraping-head top member 112 and rests against the heads of the scraping pins. Spacer 148, not visible in FIG. 1A, is shown in FIG. 1C.

Figure 2:
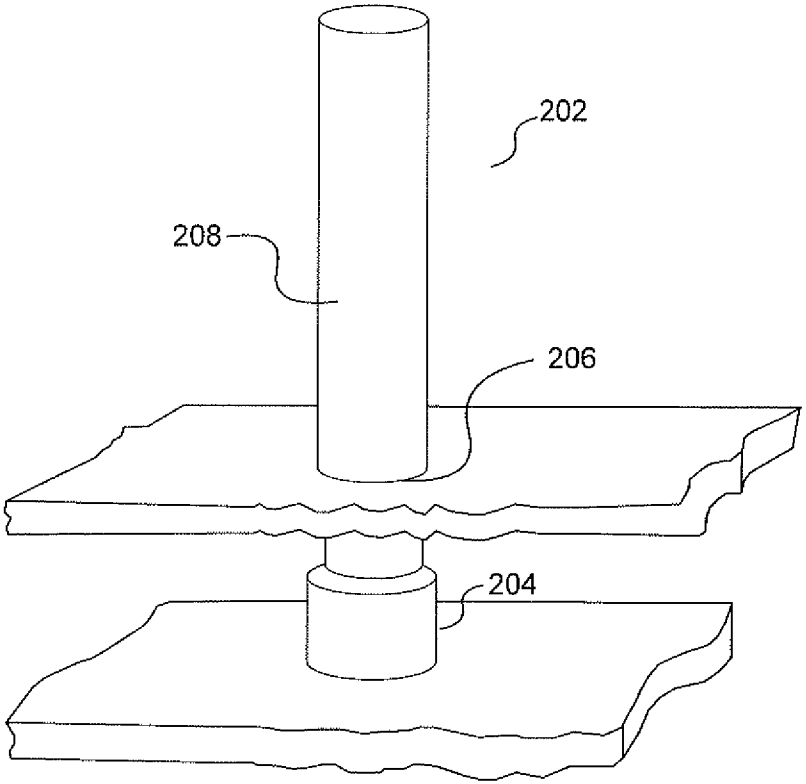
FIG. 2 illustrates a single cylindrical scraping pin passing through a portion of the trough-like scraping member with the pin head positioned against a portion of the weight bar.

FIG. 2 illustrates a single cylindrical scraping pin passing through a portion of the trough-like scraping member with the pin head positioned against a portion of the weight bar. The cylindrical scraping pin 202 includes a head 204 with a greater diameter than the inner diameter of a scraping-pin aperture 206 in the trough-like scraping member. The shaft of the scraping pin 208 has a diameter slightly less than the diameter of the scraping-pin aperture 206, allowing the scraping pin to freely slide through the trough-like scraping member.

Figure 3:
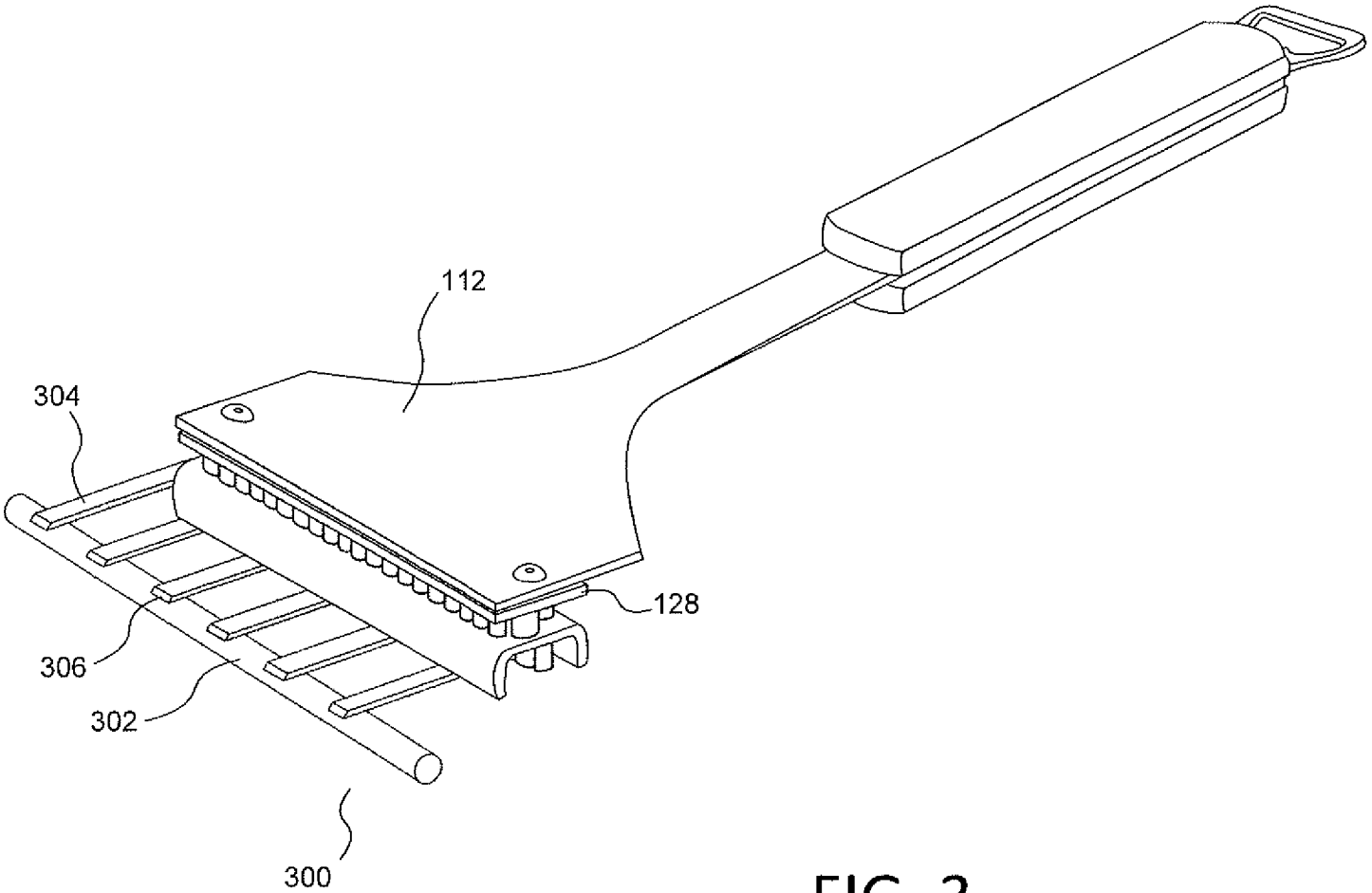
FIG. 3 shows the currently disclosed grill-cleaning tool applied to a portion of a grill.

FIG. 3 shows the currently disclosed grill-cleaning tool applied to a portion of a grill. The grill portion includes a portion of a support bar 302 and a number of orthogonal grill members, such as grill member 304. When the grill-cleaning tool is applied, in this fashion, to a grill, the scraping pins directly above the orthogonal grill members, such as grill number 304, are pushed upward, forcing the weight bar 128 upwards towards the bottom side of the cleaning-and-scraping-head top member 112. Those scraping pins that are not located above the grill members freely slide downward, until prevented from further sliding by their larger-diameter pin heads, so that the sides of the shafts of the cleaning pins lie against the vertical sides of the grill members, such as grill member 306. In this fashion, the sides of the scraping-pin shafts contribute to removing grease and cooking debris from the sides of the grill members while the bottoms of the scraping-pin shafts located above the grill members contribute to removing grease and cooking debris from the tops of the grill members. This is further described below and shown in a subsequent figure.

Figure 4:
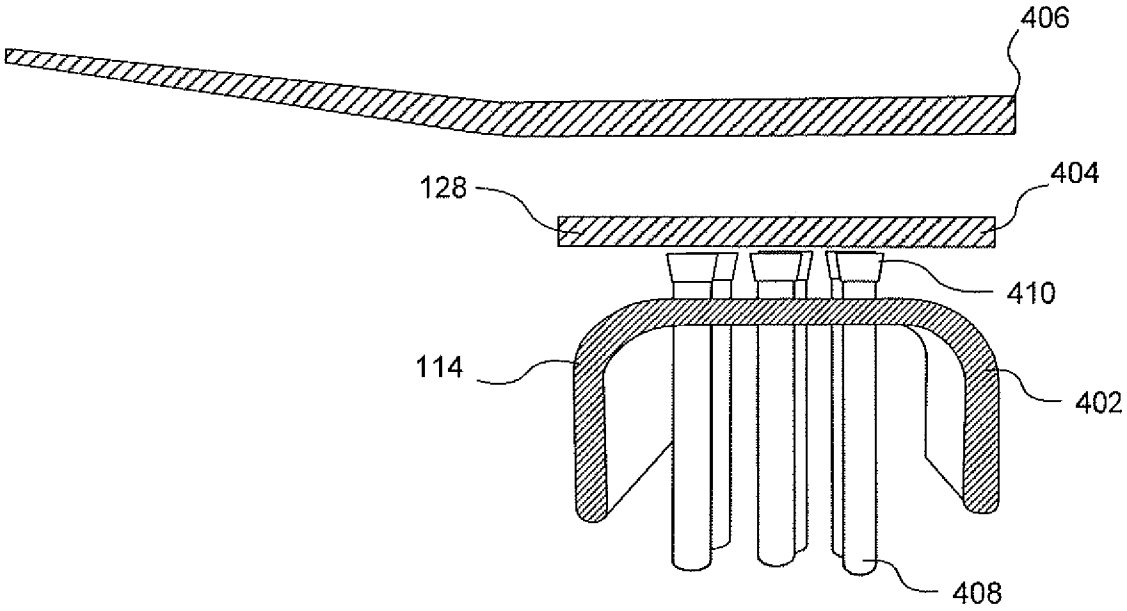
FIG. 4 provides a side-view perspective of the cleaning-and-scraping head portion of the currently disclosed grill-cleaning tool.

FIG. 4 provides a side-view perspective of the cleaning-and-scraping head portion of the currently disclosed grill-cleaning tool. The edges of the trough-like scraping member 402, the weight bar 404, and the cleaning-and-scraping-head top member 406 are illustrated with crosshatching. In this view, the positions of the scraping pins, including scraping pin 408, relative to the weight bar 128 and the trough-like scraping member 114 are clearly visible. As discussed above, the weight bar 128 rests on the top surfaces of the scraping-pin heads, such as scraping-pin head 410 of scraping pin 408. Forces resulting from application of the grill-cleaning tool to an underlying surface results in an upward force on the scraping pins that is transferred to the weight bar 128, pushing of the weight bar upwards towards the lower surface of the cleaning-and-scraping-head top member 406. However, when the grill-cleaning tool is suspended in air, the weight bar 128 and scraping pins, including scraping pin 408, are free to slide downward, under the force of gravity, until further downward vertical displacement is prevented by the scraping-pin heads encountering the smaller-diameter scraping-pin apertures in the trough-like scraping member through which the scraping-pin shafts pass.

Figure 5:
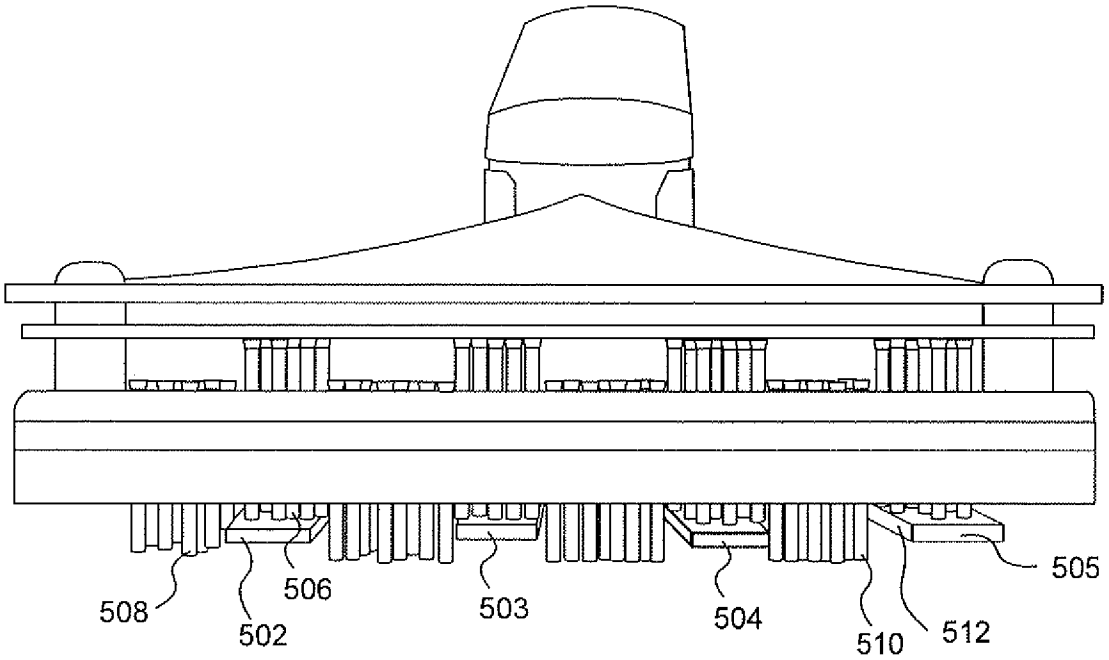
FIG. 5 illustrates conformance of the surface formed by the bottom surfaces of the scraping pins to an underlying surface.

FIG. 5 illustrates conformance of the surface formed by the bottom surfaces of the scraping pins to an underlying surface. In FIG. 5, the currently disclosed grill-cleaning tool is viewed horizontally, from the front, while the grill-cleaning tool is applied to a grill with grill members approximately parallel to the tools shaft. In FIG. 5, portions of the grill members are shown by the flattened rectangular grill members 502-505. The scraping pins overlying the grill members, such as scraping pin 506, are pushed upward relative to the scraping pins, such as scraping pin 508, that overlie spacings between the grill members. As discussed above, the surface comprising the bottom surfaces of the scraping pins thus conforms to the surface to which the grill-cleaning tool is applied. In this way, the shafts of certain of the scraping pins lie against the vertical, side surfaces of the grill members, such as the side of the shaft of scraping pin 510 lying against the vertical side 512 of grill member 505. The currently disclosed grill-cleaning tool thus applies the forward and rear scraping edges 140 and 142 and the bottom surfaces of certain of the scraping pins to the top surfaces of the grill members while applying the sides of the shafts of other scraping pins to the sides of the grill members, producing a many-surface interaction between the grill-cleaning tool and the grill reminiscent of the many-surface interaction of a brush-like device, but without the disadvantages of applying metal brushes to grill surfaces, discussed above. Because the scraping pins are held apart from one another by the pattern of scraping-pin apertures in the trough-like scraping member, they do not intertwine and clump together like brush bristles, and therefore resist clogging by grease and cooking debris. When grease and cooking debris have accumulated on the surfaces of the scraping pins and rear and forward scraping edges, the accumulated grease and cooking debris can be readily removed by immersing the cleaning-and-scraping head in a detergent/water solution and then rinsing the cleaning-and-scraping head in running water. Because the scraping pins are of substantial dimensions, generally with cross-sectional diameters or widths equal to, or greater than, 2 mm, and because the scraping pins are made from a durable and rigid material, they do not shed or break, like metal-brush bristles, and therefore cannot contaminate subsequently cooked food.

Figure 6:
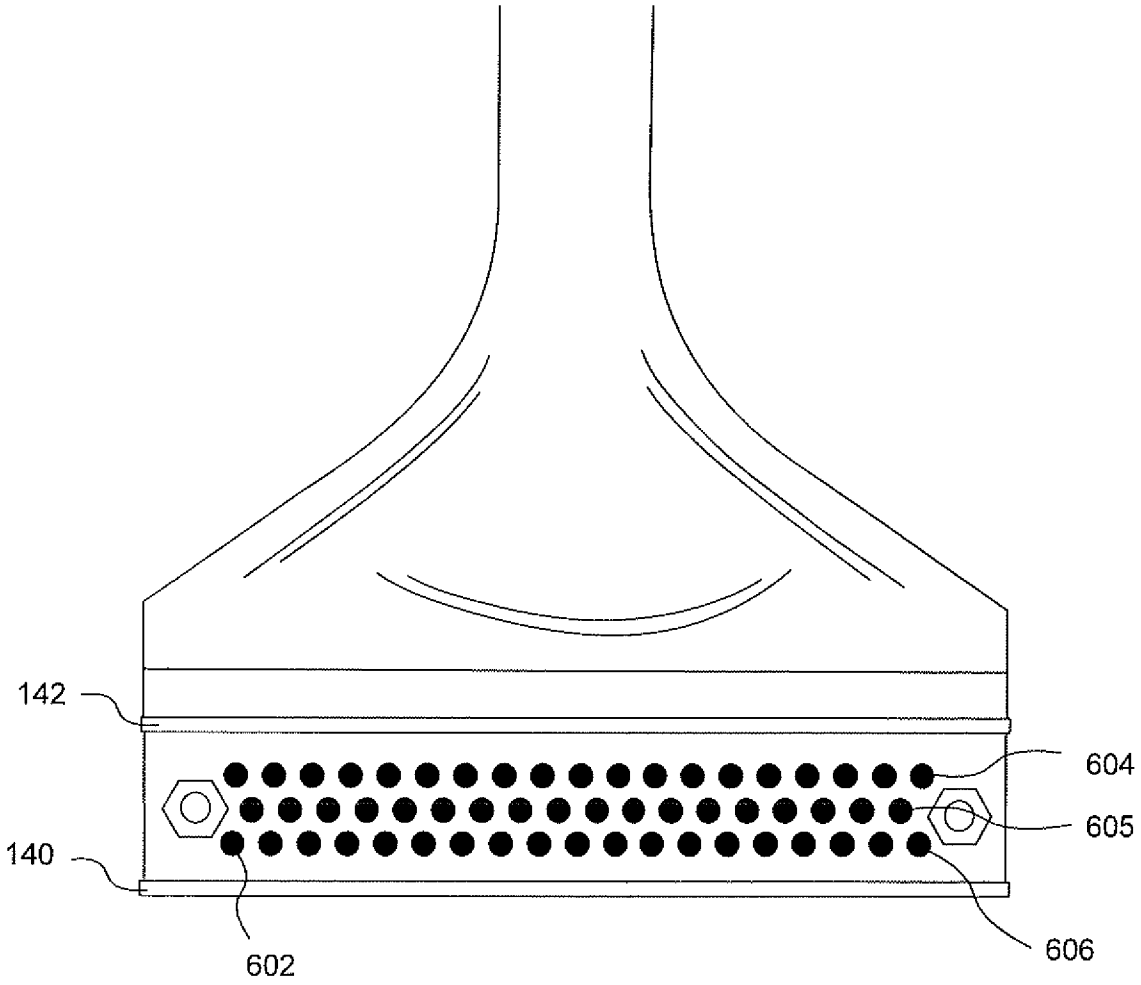
FIG. 6 provides a view of the cleaning-and-scraping head from below.

FIG. 6 provides a view of the cleaning-and-scraping head from below. In this view, the pattern of three rows of scraping-pin apertures in the trough-like scraping member are indicated by shaded disks, such as shaded disk 602. Each shaded disk can be considered either to be the bottom surface of a scraping pin or a scraping-pin aperture from which the scraping pin has been removed. In the implementation of the grill-cleaning tool shown in FIG. 6, there are three rows 604-606 of scraping-pin apertures, with the scraping-pin apertures in each row laterally offset from the scraping-pin apertures in each of one or more neighboring rows. In alternative implementations, the grill-cleaning tool may have fewer or a greater number of rows of scraping-pin apertures arranged in any of numerous different patterns. Of course, alternative implementations may feature fewer or a greater number of scraping-pin apertures and scraping pins. In the illustration illustrated in FIG. 6, the three rows of scraping-pin apertures 604-606 lie between the forward 140 and rear 142 scraping edges. In alternative implementations, two sets of scraping-pin apertures and scraping pins may lie between three scraping edges. In other alternative implementations, only a single scraping edge is used along with a set of scraping pins. In certain alternative implementations, the cleaning-and-scraping head may be circularly or elliptically shaped, rather than rectangular shaped, in which case the pattern of scraping-pin apertures may be circular or elliptical, rather than rectangular, and the forward and rear scraping edges may be curved.

Although the present invention has been described in terms of particular embodiments, it is not intended that the invention be limited to these embodiments. Modification within the spirit of the invention will be apparent to those skilled in the art. For example, as discussed above, the various components of the grill-scraping tool may be made from any of various different materials. Various implementations of the grill-scraping tool may employ different types of handles, tool shafts, and cleaning-and-scraping heads. The cleaning-and-scraping heads may feature different numbers and patterns of scraping pins, and the scraping pins may have different dimensions and cross-sections. Various different types of fasteners and spacers may be used in alternative implementations. In certain implementations, the tool shaft may be fastened to the cleaning-and-scraping head, rather than forming the top portion of the scraping-and-cleaning head, as in the implementations shown in FIGS. 1-6. Various different implementations of the grill-cleaning tool may feature differently shaped handles, tool shafts, cleaning-and-scraping heads, and scraping edges. While the currently disclosed grill-cleaning tool was designed specifically for cleaning grills, the currently disclosed grill-cleaning tool may be additional used for cleaning a wide variety of other types of irregular surfaces.

It is appreciated that the previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

The invention claimed is:

1. A hand tool comprising:

a handle; and a cleaning-and-scraping head attached to the handle that includes a scraping member that includes one or more scrapers, a set of scraping pins that, when the cleaning-and-scraping head is applied to an irregular surface, conform to the irregular surface by sliding downward within the cleaning-and-scraping head and provide additional scraping surfaces to facilitate scraping and cleaning the irregular surface by the one or more scrapers, and a weight bar that slides between a top member of the cleaning-and-scraping head and an upper portion of the scraping member.

2. The hand tool of claim of claim 1 wherein each scraping pin includes a pin head with a top surface and a pin shaft, wherein the pin shaft of each scraping pin of the set of scraping pins passes through one of the plurality of scraping-pin apertures;

wherein the pin head of each scraping pin of the set of scraping pins prevents the scraping pin from passing through the scraping-pin aperture through which the pin shaft of the scraping pin passes; and wherein the weight bar rests on the top surface of pin heads of at least one of the scraping pins when the hand tool is oriented in a position in which the scraping member is lower than the cleaning-and-scraping-head top member.

3. The hand tool of claim 2 wherein the one or more scrapers and set of scraping pins are made from a rigid, durable, and rust-resistant metal, such as stainless steel, or from other rigid, durable, and rust-resistant materials, including polymeric materials.

4. A hand tool comprising:

a handle portion; and a cleaning-and-scraping portion that includes a first, top member a second, scraping member, mounted at a fixed distance to the top member by two or more posts, that includes one or more scrapers, a weight bar that is slidably mounted to the two or more posts; and a plurality of slidable scraping pins, each having a lower surface, a pin head with a top surface, and a pin shaft, the lower surfaces of the plurality of slidable scraping pins composing a flexible surface that conforms to a surface to which the hand tool is applied and the pin shafts of the plurality of slidable scraping pins passing through scraping-pin apertures in the scraping member.

5. The hand tool of claim 4 wherein the pin head resides in the space between the top member and the scraping member; and wherein the weight bar rests on the top surface of the pin head of at least one scraping pin.

6. The hand tool of claim 4 wherein the scraping member include one or more scraping edges corresponding to the one or more scrapers.

7. The hand tool of claim 4 wherein the scraping pin apertures are arranged in a set of two or more rows, the scraping pin apertures of a first row laterally offset from the scraping pin apertures in scraping-pin rows adjacent to the first row.

8. The hand tool of claim 4 wherein the one or more scrapers and set of scraping pins are made from a rigid, durable, and rust-resistant metal, such as stainless steel, or from other rigid, durable, and rust-resistant materials, including polymeric materials.

* * * * *